US008321973B2

(12) United States Patent
Bickley

(10) Patent No.: US 8,321,973 B2
(45) Date of Patent: Dec. 4, 2012

(54) INFANT-CARRIER DOCKING STATION AND CRIB THEREWITH

(75) Inventor: Brad Thomas Bickley, Taipei (TW)

(73) Assignee: Wonderland Nurserygoods Company Limited, Central (HK)

( * ) Notice: Subject to any disclaimer, the term of this patent is extended or adjusted under 35 U.S.C. 154(b) by 5 days.

(21) Appl. No.: 13/172,837

(22) Filed: Jun. 30, 2011

(65) Prior Publication Data

US 2012/0005826 A1 Jan. 12, 2012

Related U.S. Application Data

(60) Provisional application No. 61/362,684, filed on Jul. 8, 2010.

(51) Int. Cl.
*A47D 13/02* (2006.01)

(52) U.S. Cl. ..... 5/93.1; 5/93.2; 5/95; 5/98.3

(58) Field of Classification Search ..... 5/93.1, 5/93.2, 95, 98.3
See application file for complete search history.

(56) References Cited

U.S. PATENT DOCUMENTS

| | | | | |
|---|---|---|---|---|
| 2,280,913 | A * | 4/1942 | Hummel et al. | 5/2.1 |
| 2,752,614 | A * | 7/1956 | Hayward | 5/93.1 |
| 2,823,737 | A * | 2/1958 | Eriksen | 297/440.23 |
| 5,778,465 | A | 7/1998 | Myers | |
| 6,964,071 | B1 * | 11/2005 | Lahmann | 5/93.1 |
| 7,203,981 | B1 * | 4/2007 | Cowgill | 5/109 |
| 2002/0166169 | A1 * | 11/2002 | Longenecker et al. | 5/93.1 |
| 2003/0057744 | A1 * | 3/2003 | Wilkins et al. | 297/126 |
| 2003/0177575 | A1 * | 9/2003 | Cheng et al. | 5/93.1 |
| 2006/0130237 | A1 | 6/2006 | Clapper | |
| 2006/0225205 | A1 * | 10/2006 | Troutman | 5/93.1 |
| 2008/0271243 | A1 * | 11/2008 | Burkholder et al. | 5/93.2 |
| 2009/0113624 | A1 * | 5/2009 | Tuckey | 5/93.1 |
| 2010/0229301 | A1 * | 9/2010 | Arnold et al. | 5/93.2 |
| 2012/0037870 | A1 * | 2/2012 | Fiore et al. | 256/25 |

FOREIGN PATENT DOCUMENTS

EP 1 586 483 A1 10/2005

* cited by examiner

*Primary Examiner* — William Kelleher
(74) *Attorney, Agent, or Firm* — Winston Hsu; Scott Margo

(57) ABSTRACT

An infant-carrier docking station includes a support part and a carrier holder. The support part is disposed across on opposite handrails of a crib frame. The carrier holder is connected to the support part above the crib frame. The carrier holder can hold an infant carrier of a safety seat in a detachable way. A crib includes a bed frame and the infant-carrier docking station. The infant-carrier docking station is disposed across on opposite handrails of the bed frame. Therefore, the invention is convenient for a caregiver to directly move the infant carrier from any place else to the infant-carrier docking station without waking up the baby sleeping on the infant carrier.

12 Claims, 8 Drawing Sheets

INFANT-CARRIER DOCKING STATION AND CRIB THEREWITH

CROSS REFERENCE TO RELATED APPLICATIONS

This application claims the benefit of U.S. Provisional Application No. 61/362,684, which was filed on Jul. 8, 2010 and is incorporated herein by reference.

BACKGROUND OF THE INVENTION

1. Field of the Invention

The invention relates to an infant-carrier docking station, and especially relates to an infant-carrier docking station capable of being used on a crib frame.

2. Description of the Prior Art

A current crib or playard is not equipped with any device or mechanism for supporting infant carrier. If a baby is sleeping at an infant carrier of a safety seat when going out, parents have to move the sleeping baby from the infant carrier to the crib after coming home. It is inconvenient and may wake the baby up.

SUMMARY OF THE INVENTION

An objective of the invention is to provide an infant-carrier docking station disposed on a crib frame for holding an infant carrier, so that a baby sleeping in the infant carrier can move together with the infant carrier to the infant-carrier docking station on the crib frame without moving the baby out of the infant carrier, which avoids waking the sleeping baby up easily by the moving.

The infant-carrier docking station of the invention is disposed on a crib frame. The infant-carrier docking station includes a support part and a carrier holder. The support part is disposed across on opposite handrails of the crib frame. The carrier holder is disposed on the support part. The carrier holder is capable of holding the infant carrier above the crib frame in a detachable way. Therefore, a caregiver can directly move the infant carrier from any place else to the infant-carrier docking station. During the moving, the body of a baby sleeping in the infant carrier does not feel any violent movement, so the baby can keep sleeping.

An objective of the invention is to provide an crib including the infant-carrier docking station of the invention so as to hold an infant carrier so that a baby sleeping in the infant carrier needs not be moved out of the infant carrier during a moving to the crib, which avoids waking the sleeping baby up easily by the moving.

The crib of the invention includes a bed frame, a support part, and a carrier holder. The bed frame includes handrails disposed around a circumference thereof. The support part is disposed across on opposite ones of the handrails of the bed frame. The carrier holder is disposed on the support part. The carrier holder is capable of holding an infant carrier of a safety seat above the bed frame in a detachable way. Similarly, a caregiver can directly move the infant carrier from any place else to the crib to be fixed on the infant-carrier docking station. During the moving, the body of a baby sleeping in the infant carrier does not feel any violent movement, so the baby can keep sleeping.

In sum, during a moving of the baby, by use of the infant-carrier docking station, the baby needs not to leave the infant carrier, so the baby can keep sleeping without being wakened. In addition, the crib of the invention is directly equipped with the infant-carrier docking station of the invention. It is convenient for a caregiver not only to fix the infant carrier on the crib close by, but also facilitated to move the baby into the crib. Therefore, the invention can solve the problems in the prior art embarrassing the parents for moving the baby and waking the baby in turn easily.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
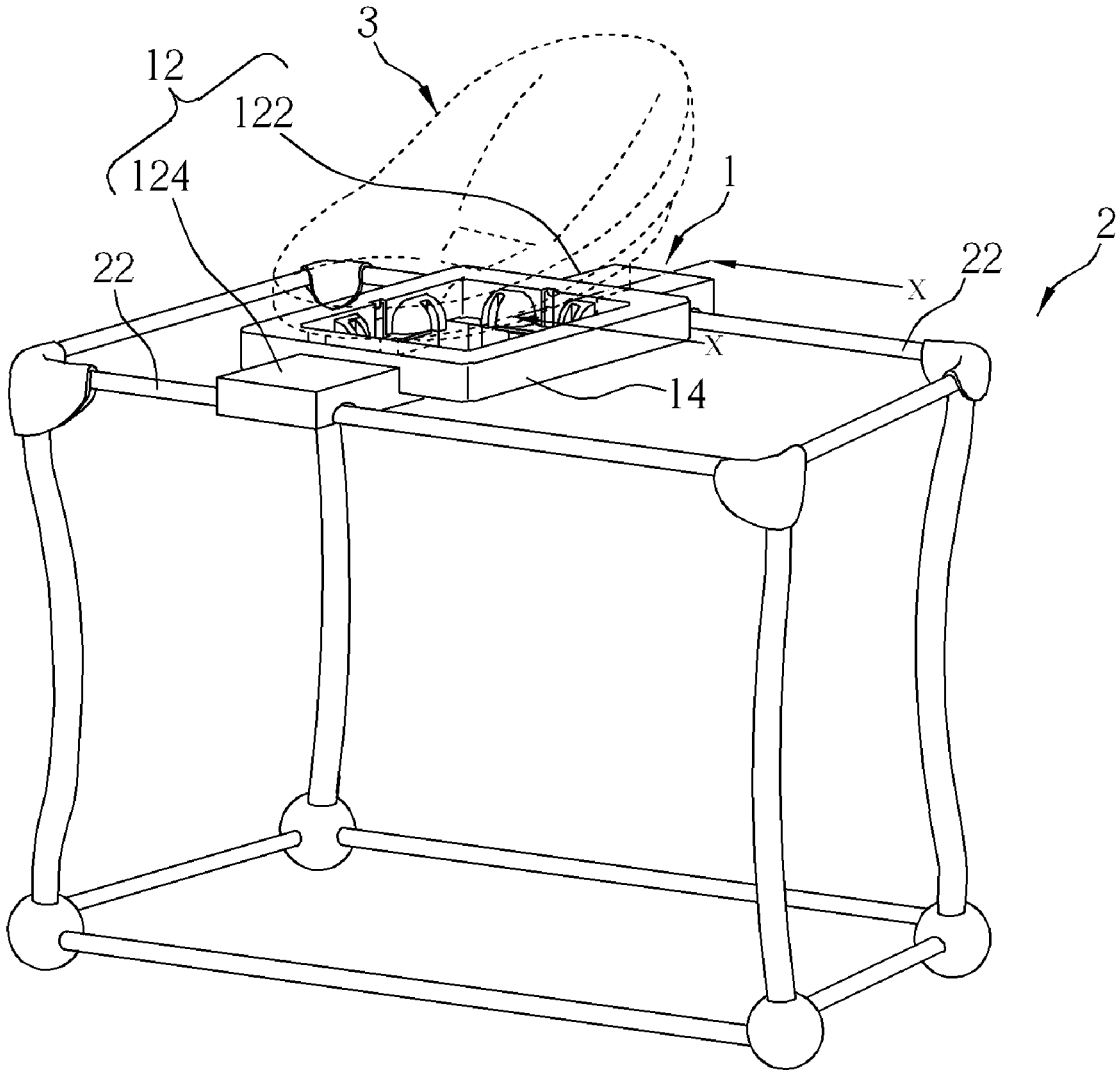
FIG. 1 is a schematic diagram of an infant-carrier docking station of a preferred embodiment according to the invention.

Please refer to FIG. 1, which is a schematic diagram of an infant-carrier docking station 1 of a preferred embodiment according to the invention. Therein, the infant-carrier docking station 1 is disposed on a crib frame 2 for holding an infant carrier 3 such as an infant carrier of a safety seat, the profile of which is shown in dashed lines. The infant-carrier docking station 1 includes a support part 12 and a carrier holder 14. The support part 12 is disposed across on opposite handrails 22 of the crib frame 2. The carrier holder 14 is connected to the support part 12 above the crib frame 2. The carrier holder 14 holds the infant carrier 3. In the embodiment, the support part 12 includes a first connecting part 122 and a second connecting part 124 which are disposed oppositely on the handrails 22 and respectively connected to the carrier holder 14; however, the invention is not limited to it. For example, a single structural member can be taken as the support part of the invention to be disposed across on the handrails 22; the carrier holder 14 is placed directly on the single structural member.

Figure 2:
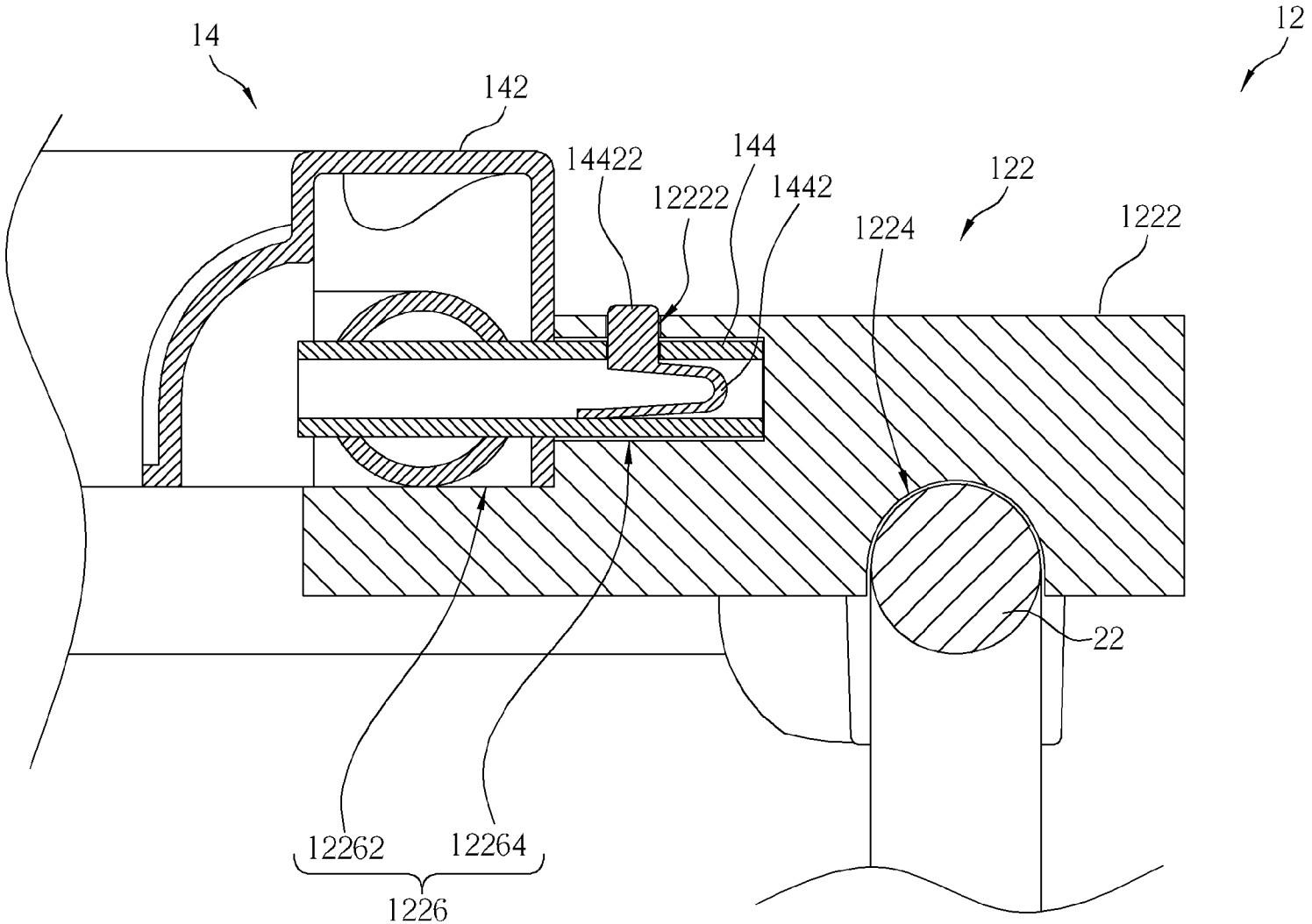
FIG. 2 is a sectional view of the first connecting part along the line X-X in FIG. 1.

Please refer to FIG. 2, which is a sectional view of the first connecting part 122 along the line X-X in FIG. 1. Therein, only sectioned portions of the first connecting part 122 and the handrail 22 are shown in the figure, and the infant carrier 3 is not shown for easy comprehension. The first connecting part 122 includes a connection base 1222, and a slot 1224 and an engagement structure 1226 which are formed on the connection base 1222. When the first connecting part 122 is disposed on the handrail 22, part of the handrail 22 extends in the slot 1224, which makes it uneasy for the first connecting part 122 to slide off. In addition, as shown in FIG. 2, the first connecting part 122 can be moved upward to be detached away from the handrails 22, so the embodiment realizes the connection structure of the support part 12 being engaged to the handrails 22 in a detachable way. However, the invention is not limited to the detachable support part in FIG. 2; the support part of the invention can alternatively be fixed on the handrails.

The engagement structure 1226 of the first connecting part 122 includes a supporting socket 12262 and two connecting hole 12264 formed on the connection base 1222. In the embodiment, the connecting holes 12264 are arranged in the direction perpendicular to the sheet of FIG. 2, so only one of the connecting holes 12264 is shown in FIG. 2. The supporting socket 12262 shows a stepped structure for placing the carrier holder 14. Connecting rods 144 of the carrier holder 14 are inserted in the connecting holes 12264. Therefore, the engagement structure 1226 performs functions of positioning and structural supporting. The connecting rod 144 preferably has a V-shaped sheet spring 1442 having an actuation button 14422 capable of passing through an engagement hole 12222 of the connection base 1222 for accomplishment of locking and positioning. For briefing description, the above description illustrates only the first connecting part 122 for example, but in the embodiment, the second connecting part 124 is equal to the first connecting part 122 in structure such that functions thereof are not repeated herein. However, it is unnecessary for the invention that the first connecting part 122 and the second connecting part 124 are equivalent in structure. In addition, it is also unnecessary for the invention that the support part mainly consists of two separate connecting parts oppositely disposed; for example, in practice, the support part can be a single structural member across on opposite handrails 22 of the crib frame 2, and the carrier holder is placed directly thereon.

Figure 3:
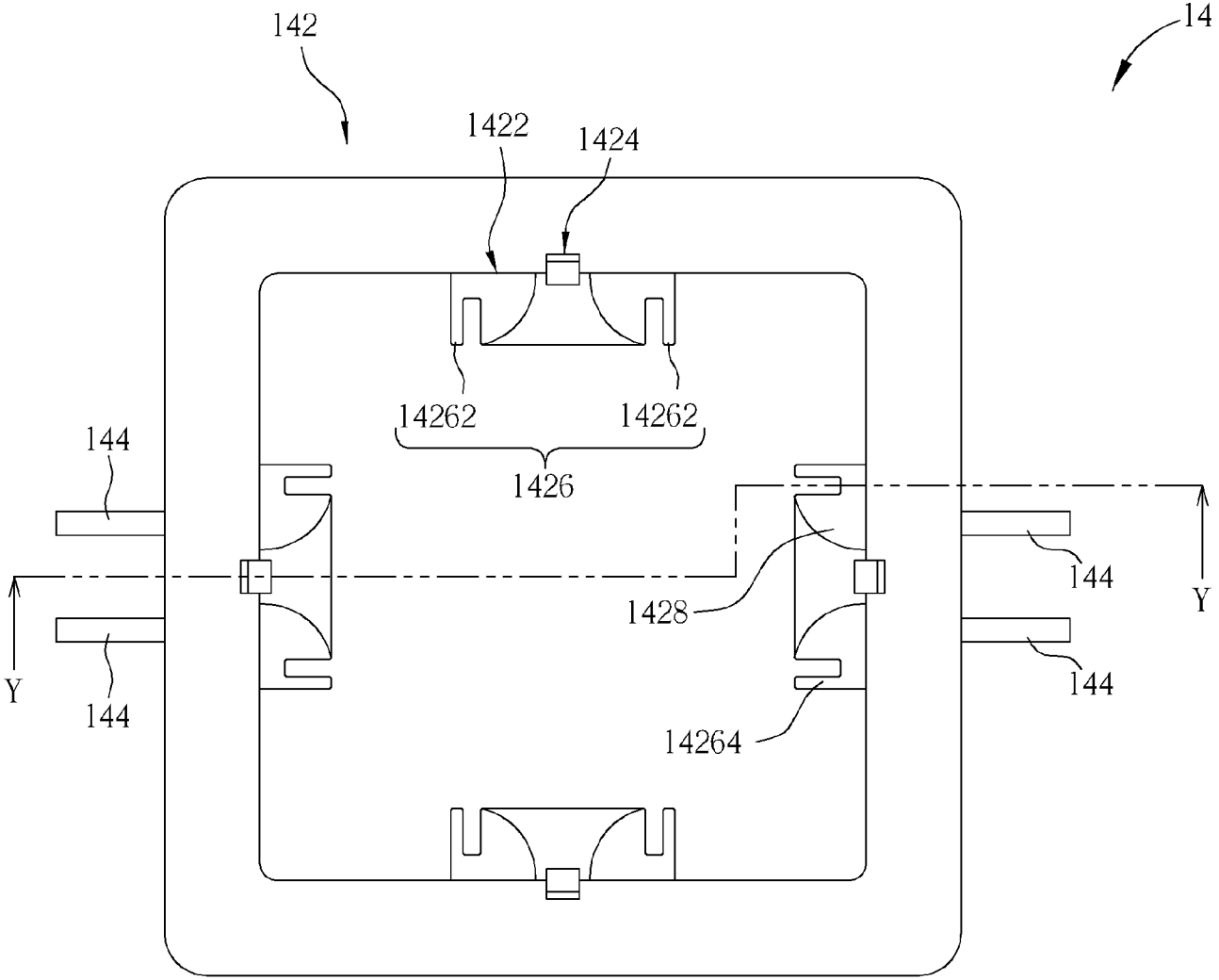
FIG. 3 is a top view of the carrier holder in FIG. 1.
Figure 4:
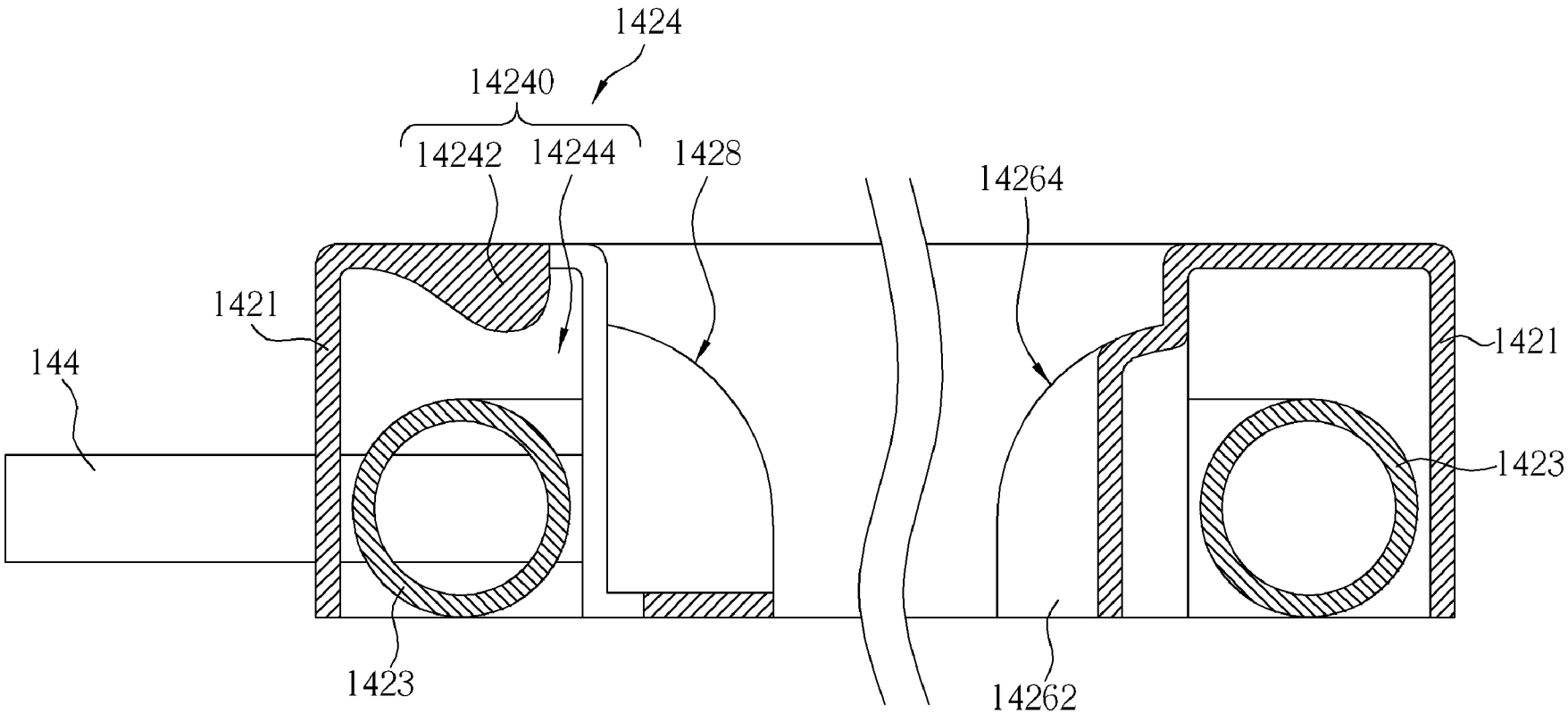
FIG. 4 is a sectional view of the carrier holder along the line Y-Y in FIG. 3.

Please refer to FIG. 3 and FIG. 4. FIG. 3 is a top view of the carrier holder 14 in FIG. 1. FIG. 4 is a sectional view of the carrier holder 14 along the line Y-Y in FIG. 3. The carrier holder 14 includes a square frame 142. Each inner side of the square frame 142 includes a structural part 1422. Each of the structural parts 1422 includes a first locking unit 1424 and a second locking unit 1426. The square frame 142 includes a casing 1421 and a reinforced tube 1423 for enhancing the strength of supporting. The first locking unit 1424 includes a locking slot 14240 mainly consists of a lip 14242 and an opening 14244 formed by the casing 1421. The second locking unit 1426 includes a couple of locking protrusions 14262 formed by the casing 1421. In the embodiment, the casing 1421, the first locking unit 1424, and the second locking unit 1426 of the square frame 142 are formed in one piece, e.g. by plastic injection. Furthermore, the reinforced tube 1423 of the square frame 142 is also formed in one piece, e.g. by bending a tube. However, the invention is not limited thereto.

In addition, the carrier holder 14 includes two pairs of connecting rods 144, which are disposed at opposite sides of the square frame 142 respectively for being connected to the first connecting part 122 and the second connecting part 124 of the support part 12. As to the connection structure thereof, please refer to FIG. 2 and relevant descriptions, which is not described herein. Furthermore, only the left connecting rod 144 of the carrier holder 14 is shown in FIG. 4 because of the cross section along line Y-Y. In the embodiment, the connecting rods 144 are connected directly to the reinforced tube 1423; however, the invention is not limited to it.

In the embodiment, except the structure difference due to the connecting rods 144, the four sets of the first locking unit 1424 and the second locking unit 1426 are disposed on the structural parts 1422 at the four inner sides of the carrier holder 14 respectively, so the infant-carrier docking station 1 can provide the same engagement structures in four orientations. That is, the infant carrier 3 can be held by the carrier holder 14 selectively in one of the four orientations. The design is convenient for a user to adjust the orientation of the infant carrier 3 desirably such as in the direction back to the sun ray for preventing stimulating the baby thereon.

Figure 5:
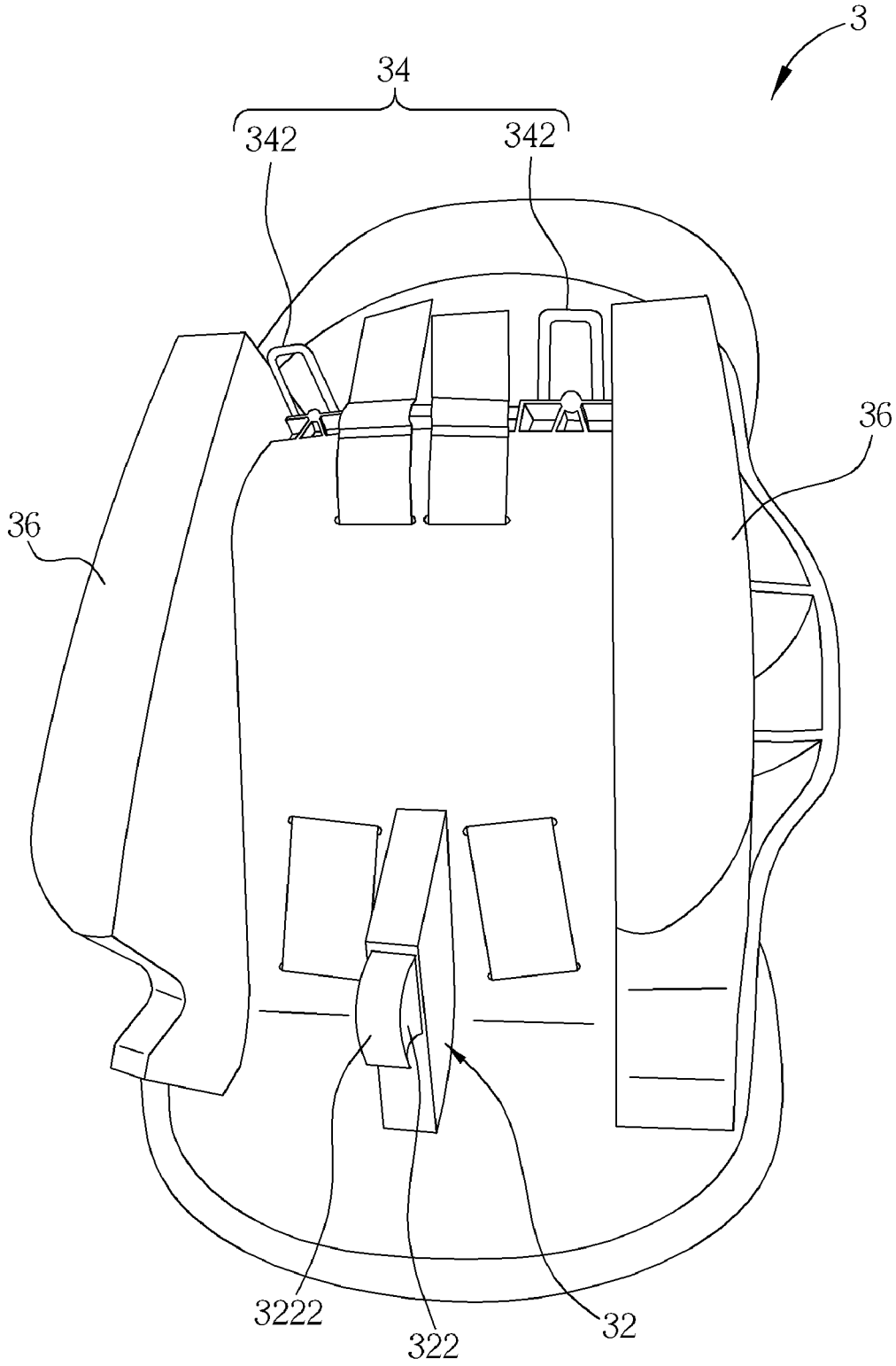
FIG. 5 is a bottom view of the infant carrier in FIG. 1.

Please refer to FIG. 5, which is a bottom view of the infant carrier 3 in FIG. 1. The infant carrier 3 includes a third locking unit 32 and a fourth locking unit 34. The third locking unit 32 can be engaged with any one of the first locking units 1424; the fourth locking unit 34 can be engaged with any one of the second locking units 1426. In the embodiment, the third locking unit 32 includes a rotational hook 322; the fourth locking unit 34 includes a couple of rotational locking rings 342.

Figure 6:
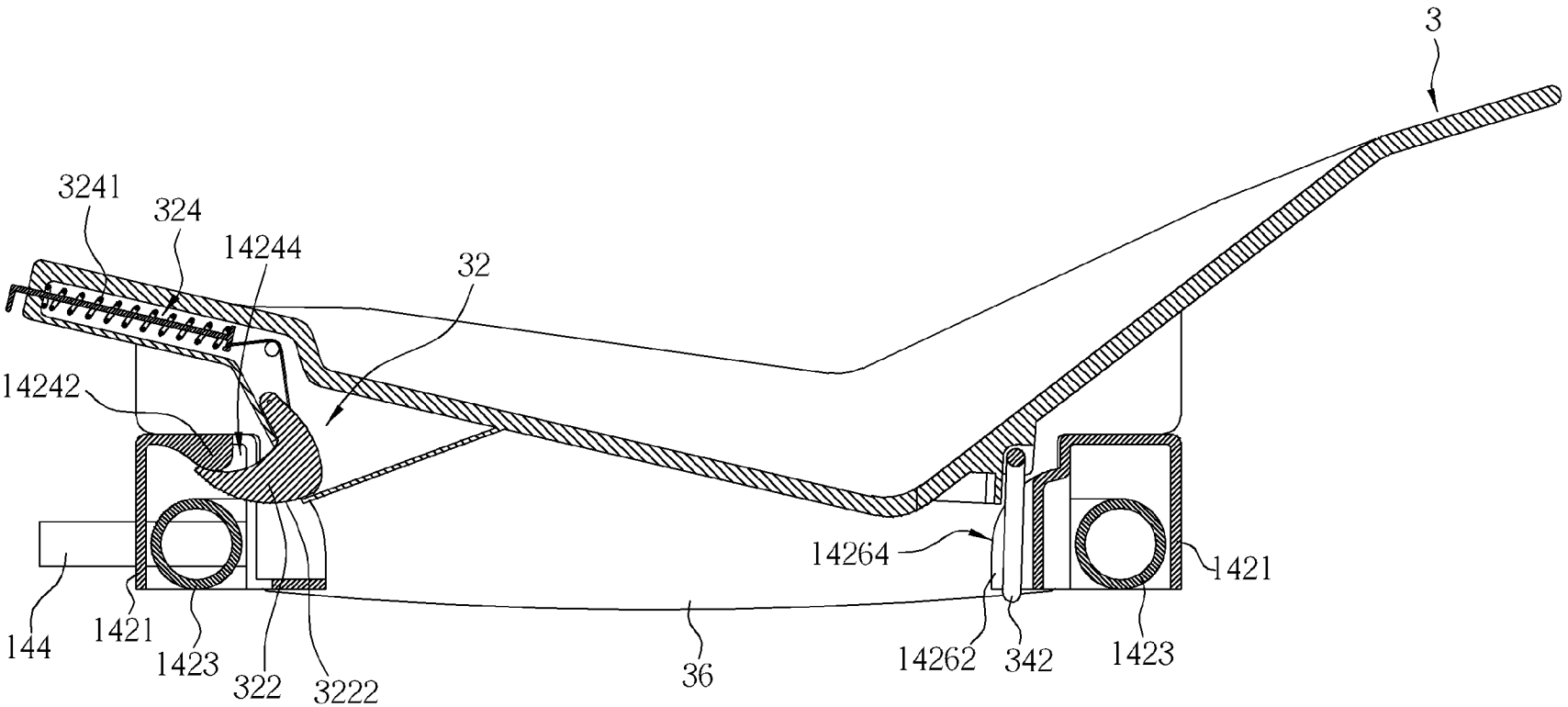
FIG. 6 is a sectional view of the infant carrier disposed on the carrier holder.

Please also refer to FIG. 6, which is a sectional view of the infant carrier 3 disposed on the carrier holder 14; therein, the position of the cross-section is corresponding to the line Y-Y in FIG. 3. A couple of ribs 36 of the infant carrier 3 are accommodated inside the square frame 142. The hook 322 of the third locking unit 32 of the infant carrier 3 can be hooked in the locking slot 14240 of the first locking unit 1424. The locking rings 342 of the fourth locking unit 34 can be passed through by the locking protrusions 14262 of the second locking unit 1426. Regarding the operation of engaging the infant carrier 3 with the carrier holder 14, in the embodiment, when the infant carrier 3 is placed onto the carrier holder 14, the hook 322 rotates by use of the guidance of an arc surface 3222 of the hook 322 interfering with the casing 1421 and then rotates back to extend into the locking slot 14240. Similarly, the locking ring 342 rotates under the interference with an arc surface 14264 formed on the casing 1421 above the locking protrusion 14262 and then returns back to hook the locking protrusion 14262 after getting rid of the interference with the arc surface 14264. The returning for the locking ring 342 is driven by a resilient part 3241 of an actuation mechanism 324.

Figure 7:
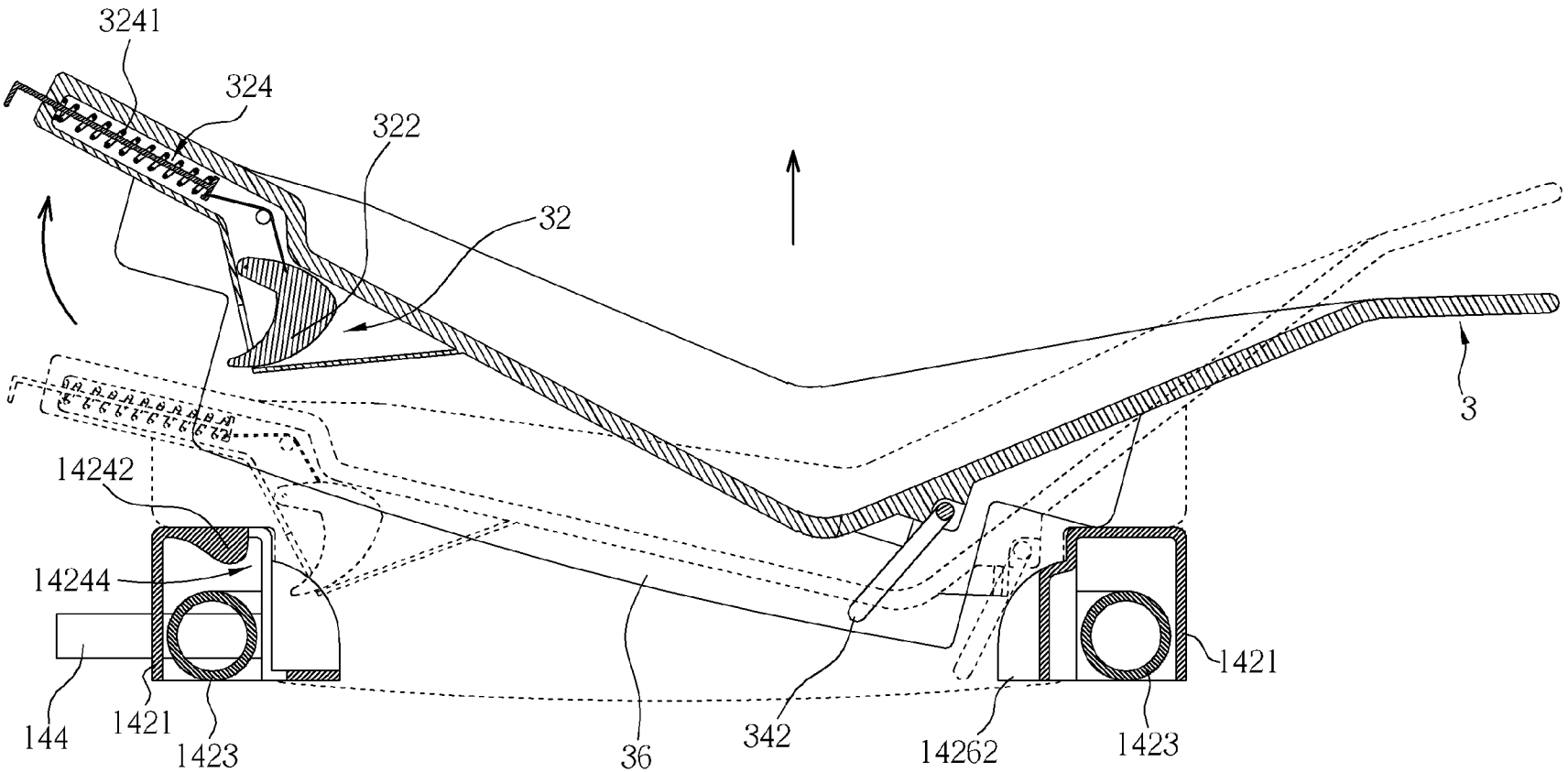
FIG. 7 is a schematic diagram illustrating the operation of detaching the infant carrier from the carrier holder.

Please refer to FIG. 7, which is a schematic diagram illustrating the operation of detaching the infant carrier 3 from the carrier holder 14. In the embodiment, when the infant carrier 3 is to be detached from the carrier holder 14, the actuation mechanism 324 can be manipulated to drive the hook 322 of the third locking unit 32 and the locking rings 342 of the fourth locking unit 34 to rotate simultaneously (as shown in dashed lines in FIG. 7), so as to be detached from the locking slot 14240 of the first locking unit 1424 and the locking protrusions 14262 of the second locking unit 1426 respectively. At this moment, the infant carrier 3 has been disengaged from the carrier holder 14; then, the user can lift the infant carrier 3 up until being detached from the carrier holder 14 completely. The connection of the actuation mechanism 324 with the hook 322 of the third locking unit 32 and the locking rings 342 of the fourth locking unit 34 can be realized by the prior art and is not described in detail herein.

Figure 8:
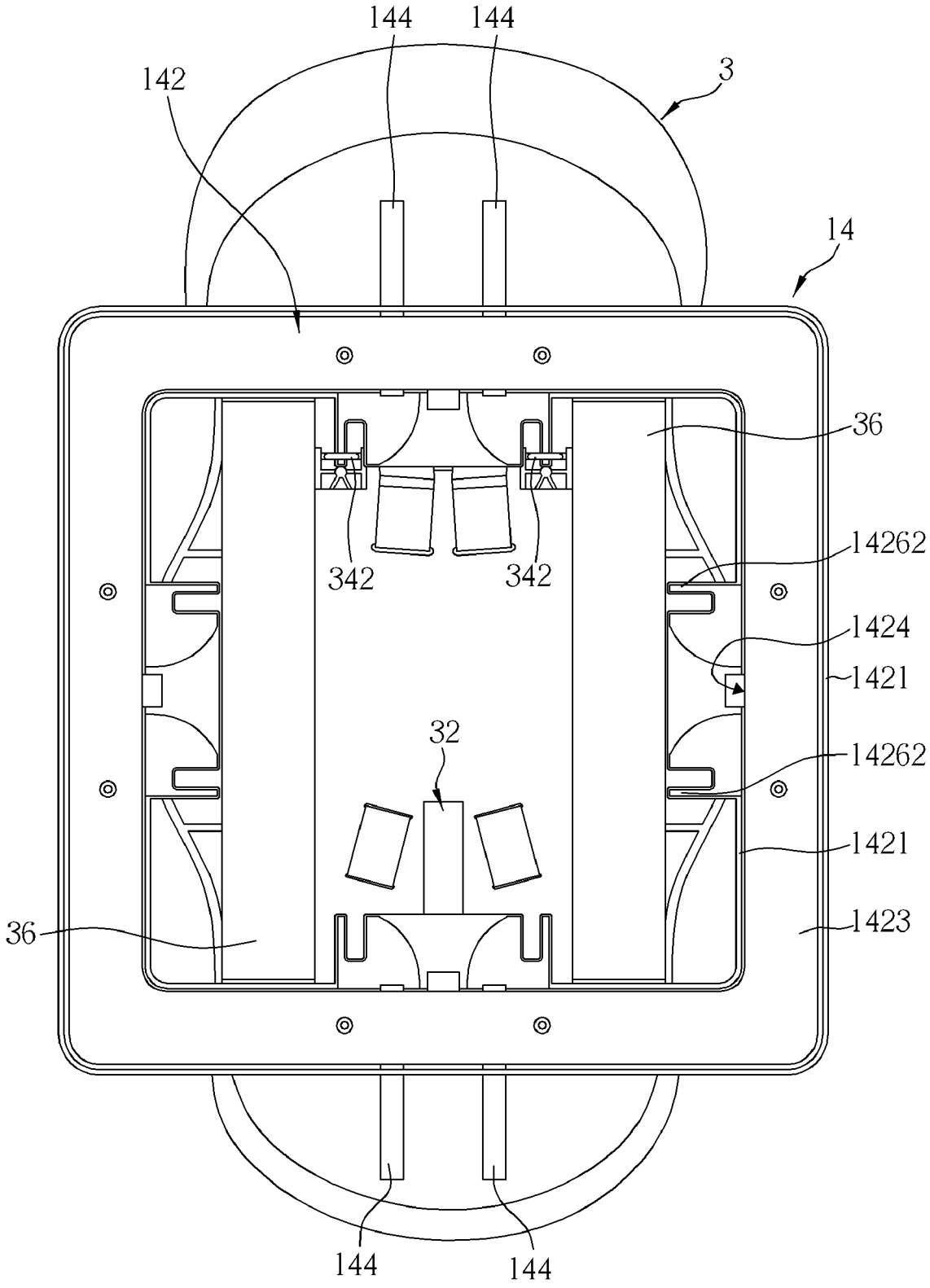
FIG. 8 is a bottom view of the infant carrier engaged with the carrier holder.

Depending on the description of the above embodiment, the infant carrier 3 being engaged with the carrier holder 14 does not use the first locking unit 1424 and the second locking unit 1426 at the same side but the first locking unit 1424 and the second locking unit 1426 at the opposite sides respectively. Furthermore, please refer to FIG. 8, which is a bottom view of the infant carrier 3 engaged with the carrier holder 14; therein, the support part 12 is not shown in FIG. 8. By the view of FIG. 8, in the embodiment, only the upper and the lower structural parts 1422 are engaged with the infant carrier 3. However, the left and the right structural parts 1422 can restrain the ribs 36 of the infant carrier 3 by use of the arc surfaces 1428 (referring to FIG. 3 and FIG. 4) formed on the casing 1421 adjacent to the first locking unit 1424 and the second locking unit 1426, which also provides indirect guidance to the engagement of the locking units. Furthermore, after the infant carrier 3 is engaged with the carrier holder 14, the left and the right structural parts 1422 keeps restraining the ribs 36 of the infant carrier 3 for auxiliary fixing.

Depending on the description of the above embodiment, by use of the infant-carrier docking station of the invention, a caregiver can directly move the infant carrier to the infant-carrier docking station. A baby on the infant carrier can be moved needless of leaving the infant carrier, therefore the opportunity to wake the baby up can be reduced effectively; therefore, the baby can keep sleeping. In addition, the crib of the invention has been equipped with the infant-carrier docking station of the invention, so there is no need for additional device or structure for disposing the infant-carrier docking station. The caregiver can fix the infant carrier on the crib close by and then can move the baby into the crib. Therefore, the invention can effectively solve the problems in the prior art of the inconvenience of parents moving the baby and waking the baby up easily during the moving or transporting thereof.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant-carrier docking station, disposed on a crib frame for holding an infant carrier, the infant-carrier docking station comprising:

a support part, disposed across on opposite handrails of the crib frame; and a carrier holder, connected to the support part above the crib frame, the carrier holder being capable of holding the infant carrier in a detachable way, the carrier holder comprising:

a casing; and a reinforced tube, wherein the casing and the reinforced tube are connected together to form a square frame, wherein each inner side of the square frame comprises a structural part comprising a first locking unit and a second locking unit, the infant carrier comprises a third locking unit and a fourth locking unit, the third locking unit is capable of being engaged with any one of the first locking units, and the fourth locking unit is capable of being engaged with the second locking unit opposite to the one of first locking units.

2. The infant-carrier docking station of claim 1, wherein the support part is engaged to the handrails in a detachable way.

3. The infant-carrier docking station of claim 1, wherein the support part comprises a first connecting part and a second connecting part which are disposed oppositely on the handrails and respectively connected to the carrier holder.

4. The infant-carrier docking station of claim 1, wherein the first locking unit comprises a locking slot, the third locking unit comprises a rotational hook, and the hook is locked in the locking slot selectively.

5. The infant-carrier docking station of claim 1, wherein the second locking unit comprises a couple of locking protrusions, the fourth locking unit comprises a couple of rotational locking rings, and the locking rings are locked with the locking protrusions selectively.

6. A crib, comprising:

a bed frame, comprising handrails disposed around a circumference thereof;

a support part, disposed across on opposite ones of the handrails; and a carrier holder, connected to the support part above the bed frame, the carrier holder being capable of holding an infant carrier of a safety seat in a detachable way, the carrier holder comprising:

a casing; and a reinforced tube, wherein the casing and the reinforced tube are connected together to form a square frame, wherein each inner side of the square frame comprises a structural part comprising a first locking unit and a second locking unit, the infant carrier comprises a third locking unit and a fourth locking unit, the third locking unit is capable of being engaged with any one of the first locking units, and the fourth locking unit is capable of being engaged with the second locking unit opposite to the one of first locking units.

7. The crib of claim 6, wherein the support part is engaged to the handrails in a detachable way.

8. The crib of claim 6, wherein the support part comprises a first connecting part and a second connecting part which are disposed oppositely on the handrails and respectively connected to the carrier holder.

9. The crib of claim 6, wherein the first locking unit comprises a locking slot, the third locking unit comprises a rotational hook, and the hook is locked in the locking slot selectively.

10. The crib of claim 6, wherein the second locking unit comprises a couple of locking protrusions, the fourth locking unit comprises a couple of rotational locking rings, and the locking rings are locked with the locking protrusions selectively.

11. An infant-carrier docking station, disposed on a crib frame for holding an infant carrier, the infant-carrier docking station comprising:

a support part, disposed across on opposite handrails of the crib frame; and a carrier holder, connected to the support part above the crib frame, the carrier holder being capable of holding the infant carrier in a detachable way, the carrier holder comprising a square frame, wherein each inner side of the square frame comprises a first locking unit and a second locking unit, the infant carrier capable of being engaged with the square frame in one of four different orientations corresponding to the inner sides of the square frame.

12. A crib, comprising:

a bed frame, comprising handrails disposed around a circumference thereof;

a support part, disposed across on opposite ones of the handrails; and a carrier holder, connected to the support part above the bed frame, the carrier holder being capable of holding an infant carrier of a safety seat in a detachable way, the carrier holder comprising a square frame, wherein each inner side of the square frame comprises a first locking unit and a second locking unit, the infant carrier capable of being engaged with the square frame in one of four different orientations corresponding to the inner sides of the square frame.

* * * * *